US005821441A

United States Patent [19]

Kawamura

[11] Patent Number: 5,821,441

[45] Date of Patent: Oct. 13, 1998

[54] TOUGH AND CORROSION-RESISTANT TUNGSTEN BASED SINTERED ALLOY AND METHOD OF PREPARING THE SAME

[75] Inventor: Toshio Kawamura, Hyogo, Japan

[73] Assignee: Sumitomo Electric Industries, Ltd., Osaka, Japan

[21] Appl. No.: 607,693

[22] Filed: Feb. 27, 1996

Related U.S. Application Data

[63] Continuation-in-part of Ser. No. 319,871, Oct. 7, 1994, abandoned.

[30] Foreign Application Priority Data

| | | | |
|---|---|---|---|
| Oct. 8, 1993 | [JP] | Japan | 5-277733 |
| Sep. 20, 1994 | [JP] | Japan | 6-251280 |
| Aug. 29, 1995 | [JP] | Japan | 7-220383 |

[51] Int. Cl.[6] ..... C22C 1/04; C22C 27/00

[52] U.S. Cl. ..... 75/248; 420/430

[58] Field of Search ..... 75/248; 420/430

[56] References Cited

U.S. PATENT DOCUMENTS

| | | | |
|---|---|---|---|
| 2,227,446 | 1/1941 | Driggs et al. | 75/176 |
| 3,888,636 | 6/1975 | Sczerzenie et al. | 29/182 |
| 3,988,118 | 10/1976 | Grierson et al. | 29/182 |
| 4,012,230 | 3/1977 | Dickenson et al. | 75/212 |
| 4,498,395 | 2/1985 | Kock et al. | 102/517 |
| 4,698,096 | 10/1987 | Schmidberger et al. | 75/248 |
| 4,743,512 | 5/1988 | Marlowe et al. | 428/552 |
| 4,762,559 | 8/1988 | Penrice et al. | 428/552 |
| 4,784,690 | 11/1988 | Mullendore | 75/248 |
| 4,801,330 | 1/1989 | Bose et al. | 75/298 |
| 5,064,462 | 11/1991 | Mullendore et al. | 75/248 |
| 5,294,269 | 3/1994 | Lee et al. | 148/514 |
| 5,462,576 | 10/1995 | Stuitje et al. | 75/248 |

FOREIGN PATENT DOCUMENTS

| | | |
|---|---|---|
| 54-80208 | 6/1979 | Japan . |
| 58-144401 | 8/1983 | Japan . |
| 2-163337 | 6/1990 | Japan . |
| 3-146605 | 6/1991 | Japan . |
| 4-124243 | 4/1992 | Japan . |

*Primary Examiner*—Daniel J. Jenkins
*Attorney, Agent, or Firm*—W. F. Fasse; W. G. Fasse

[57] ABSTRACT

A tungsten based sintered alloy has excellent corrosion resistance under high temperatures and high humidities, and has good toughness. The alloy can be employed as such without requiring further corrosion protection such as Ni plating, due to its corrosion resistance, and allows for plastic deformation such as caulking, due to its toughness or good elongation. The tough corrosion-resistant tungsten based sintered alloy consists of 80 to 97 percent by weight of tungsten, and a remainder of Ni, Co, and optionally Fe and unavoidable impurities. The alloy most particularly has a Co content of at least 2 and not more than 60 percent by weight, an Fe content of more than 0 and less than 5 percent by weight, and a remainder of Ni in a Ni—Co—Fe binder phase.

19 Claims, 1 Drawing Sheet

TOUGH AND CORROSION-RESISTANT TUNGSTEN BASED SINTERED ALLOY AND METHOD OF PREPARING THE SAME

CROSS-REFERENCE TO RELATED APPLICATION

This application is a Continuation-In-Part of my earlier copending application U.S. Ser. No. 08/319,871, filed on Oct. 7, 1994.

BACKGROUND OF THE INVENTION

1. Field of the Invention

The present invention relates to a tungsten based sintered alloy having high specific gravity which is applied to an inertial body or the like, and more particularly, it relates to a tungsten based sintered body having high corrosion resistance and toughness. The invention further relates to a method of preparing such an alloy.

2. Description of the Background Art

A tungsten based sintered alloy, which is prepared by dispersing tungsten in a binder phase of Ni, Fe and the like, can be used for an inertial body such as a weight, due to its high specific gravity, as well as for a metal mold for die casting, an electrode material, a medical radiation shield or the like, due to its excellent heat resistance, elastic modulus and heat conductivity and its radiation shielding effect.

An example of the aforementioned inertial body is a vibrator element used in a miniature vibration generator integrated in a paging type miniature radio caller, e.g. a so-called pager. Such a vibrator element is most generally prepared from a high specific gravity alloy mainly composed of tungsten (W), i.e. a tungsten based sintered alloy, which can satisfy conditions required for the vibrator element such as miniaturization, compactness and high moment of inertia.

For example, Japanese Patent Laying-Open No. 3-146605 (1991) discloses a vibrator element which consists of a tungsten based sintered alloy such as W—Ni—Fe, W—Ni—Cu or W—Mo—Ni—Fe for application to a vibrator element employed for a vibration generator of a miniature radio caller. The feature of the vibrator element consisting of such a tungsten based sintered alloy resides in that it can be fixed to a rotary shaft of a miniature motor by caulking, due to its excellent ductility provided by a heat treatment including heating and thereafter quenching the same.

However, such a conventional tungsten based sintered alloy is so easy to corrode that tungsten hydroxide or iron oxide is formed under a high temperature and high humidity and then breaks or flakes off in a powdery state, whereupon it adheres to another part such as the rotary shaft of the motor and causes problems such as an imperfect operation or a contact failure. In general, therefore, it is necessary to preserve the surface of the tungsten based sintered alloy by Ni plating or the like, in order to use the alloy for the aforementioned vibrator element, an automobile part or an electronic part.

As hereinabove described, it is necessary to preserve the surface of the tungsten based sintered alloy by Ni plating or the like, in order to prevent corrosion. Thus, the conventional tungsten based sintered alloy is inferior in productivity, and results in a high cost. While a thickness of about 2 to 6 $\mu$m is generally required for an Ni plating film for preservation, the yield of the conventional tungsten based sintered alloy is reduced by inferior or imperfect adhesion of the plating film or inferior plating quality caused by blistering or the like, leading to insufficient reliability of the sintered alloy.

U.S. Pat. No. 5,064,462 (Mullendore et al. '462) discloses a W—Ni—Co alloy with a particular grain structure achieved by solid state sintering followed by liquid phase sintering. The alloy is particularly to be used for making armor penetrator projectiles. The alloy has a composition of 90 to 98 weight percent tungsten, with the remainder being nickel and cobalt, wherein the weight ratio of nickel to cobalt is between 1:1 and 9:1. Mullendore et al. '462 teach that the composition must be within the disclosed composition ranges in order to achieve the desired characteristics. Mullendore et al. '462 are not directly concerned with the corrosion resistance of their alloy, and do not disclose what alloy compositions are required for achieving good corrosion resistance.

U.S. Pat. No. 4,762,559 (Penrice et al. '559) discloses a W—Ni—Fe—Co high density alloy and a particular sintering process for making the alloy. The alloy can be used, for example, as a kinetic energy penetrator with improved ballistic performance and material characteristics. The alloy contains about 85 to 98 wt. % of tungsten with the balance being a binder phase essentially consisting of nickel, iron, and cobalt. The concentration ranges in the binder phase are about 30 to 90% nickel, 5 to 65% iron, and 5 to 47.5% cobalt, with the amount of cobalt being at least equal to or less than the nickel content. The alloys are said to have improved hardness and tensile strength properties while retaining ductility. Penrice et al. '559 teach that it is essential for the composition, and especially the cobalt content, to be limited to the disclosed range in order to obtain the desired properties. Penrice et al. '559 are not directly concerned with the corrosion resistance of their alloy, and do not disclose what alloy compositions are required for achieving good corrosion resistance, especially in combination with good toughness.

SUMMARY OF THE INVENTION

In consideration of the aforementioned prior art, an object of the present invention is to provide a tungsten based sintered alloy having particularly good corrosion resistance and toughness, whereby the alloy can be employed as is, without needing any preservation such as Ni plating, due to improvement in its corrosion resistance under a high temperature and high humidity, and whereby the alloy allows for plastic deformation such as caulking.

In order to achieve the above mentioned objects, the invention provides tungsten based sintered alloys according to first and second aspects of the invention. The first aspect of the invention is broader, and provides a general corrosion-resistance tungsten based sintered alloy. The second aspect of the present invention relates to more-limited ranges of tungsten based sintered alloys that achieve particularly good corrosion resistance and simultaneously provide very good toughness. Furthermore, the sample materials prepared according to the invention, as described below, demonstrate that tungsten based sintered alloy compositions having an Ni—Co or Ni—Co—Fe binder phase achieve good corrosion resistance both inside of and outside of the compositional ranges disclosed by the prior art discussed above. The patentable features of the present invention thus relate especially to the compositions outside of the prior art ranges.

The corrosion-resistant tungsten based sintered alloy provided according to the first aspect of the present invention consists of 80 to 97 percent by weight of W and a remainder of Ni and Co, or Ni, Co and Fe, and unavoidable impurities. The Ni—Co based binder phase includes 10 to 98 percent by weight of Ni and 2 to 90 percent by weight of Co in the ratio of Ni and Co. The Ni—Co—Fe based binder phase includes 10 to 98 percent by weight of Ni, 2 to 90 percent by weight of Co and not more than 70 percent by weight of Fe in the ratios of Ni, Co and Fe.

The tungsten based sintered alloy according to the second aspect of the present invention consists of 80 to 97 percent by weight of tungsten and a remainder of Ni, Co and Fe and unavoidable impurities with a Co content of at least 2 percent by weight and preferably not more than 60 percent by weight, an Fe content in excess of 0 percent by weight and less than 5 percent by weight, and a remainder of Ni in a combination of Ni—Co—Fe.

According to the present invention, it is possible to obtain a corrosion-resistant tungsten based sintered alloy having toughness or good ductility and excellent corrosion resistance, which can be employed as such without requiring preservation against corrosion, by selecting the W content in a specific range, forming the binder phase by the combination of Ni and Co, or of Ni, Co and Fe, and controlling the composition of the binder phase.

In the inventive tungsten based sintered alloy, the W content is set in the range of at least 80 percent by weight and not more than 97 percent by weight for the following reason. If the W content is less than 80 percent by weight, deformation is caused during sintering due to an excessive proportion of the binder phase consisting of Ni and Co, or Ni, Co and Fe. If the W content exceeds 97 percent by weight, on the other hand, the alloy of the first aspect is reduced in ductility and the alloy of the second aspect is reduced in toughness, which causes difficulty in plastic deformation such as caulking and machining due to reduction of the binder phase.

In the first aspect of the invention, when the binder phase is formed by the combination of Ni and Co, the Ni content is set in the range of 10 to 98 percent by weight since it is difficult to sinter the mixed powder if the Ni content is less than 10 percent by weight or the Co content exceeds 90 percent by weight, while the corrosion resistance of the resulting alloy is reduced if the Ni content exceeds 98 percent by weight or the Co content is less than 2 percent by weight.

Further according to the first aspect of the invention, when the binder phase is formed by the combination of Ni, Co and Fe, the Ni content is set in the range of 10 to 98 percent by weight, because the resultant alloy will easily corrode under a high temperature and high humidity due to deposition of an α-Fe phase in the binder phase if the Ni content is less than 10 percent by weight and the Fe content exceeds 70 percent by weight, while it is difficult to sinter the mixed powder if the Fe content is less than 10 percent by weight. Further, the alloy as formed is reduced in corrosion resistance if the Ni content exceeds 98 percent by weight. The Co content is set in the range of 2 to 90 percent by weight since the alloy is reduced in corrosion resistance if the Co content is less than 2 percent by weight, while it is difficult to sinter the mixed powder if the Co content exceeds 90 percent by weight. Further, the Fe content is set to be not more than 70 percent by weight since an α-Fe phase is easily deposited in the binder phase to cause corrosion in the alloy under a high temperature and high humidity if the Fe content exceeds 70 percent by weight.

Particularly when the composition of the binder phase formed by Ni and Co or Ni, Co and Fe according to the first aspect of the invention is in a range which is enclosed with points A, B, C and D in a composition diagram shown in FIG. 1, it is possible to obtain a tungsten based sintered alloy having remarkably excellent corrosion resistance. In other words, it is possible to attain remarkably excellent corrosion resistance when the Ni content is in a range of 40 to 98 percent by weight in the combination of Ni and Co, or the composition of Ni, Co and Fe is in the range which is enclosed with the point A (98 percent by weight of Ni and 2 percent by weight of Co), the point B (88 percent by weight of Ni, 2 percent by weight of Co and 10 percent by weight of Fe), the point C (10 percent by weight of Ni, 60 percent by weight of Co and 30 percent by weight of Fe) and the point D (40 percent by weight of Ni and 60 percent by weight of Co).

In the tungsten based sintered alloy according to the second aspect of the present invention, the binder phase consisting of Ni, Co and Fe enclosing and binding the tungsten particles is composed of Co in a content of at least 2 percent by weight and preferably not more than 60 percent by weight, Fe in a content in excess of 0 percent by weight and less than 5 percent by weight, and a remainder of Ni in the ratios of Ni—Co—Fe. The Co content is limited to the stated range, because the corrosion resistance of the alloy is reduced if the Co content is less than 2 percent while the toughness thereof is reduced if the Co content exceeds 60 percent by weight. On the other hand, the Fe content is limited to the stated range, because the toughness is reduced if the Fe content is 0 percent by weight while an α-Fe phase may be partially deposited in the binder phase to more easily cause corrosion under high temperature and high humidity conditions if the Fe content exceeds 5 percent by weight.

A method of preparing the inventive sintered alloys will now be described. The tungsten based sintered alloy according to the present invention consists of tungsten particles and a binder phase of Ni—Co or Ni—Co—Fe. This binder phase develops a liquid phase in the sintering process, to enclose the tungsten particles. More specifically, a method of preparing the inventive tungsten based sintered alloy involves a first step of mixing 80 to 97 percent by weight of W powder and a remainder of Ni powder and Co powder, or Ni powder, Co powder and Fe powder. The mixed powder contains 10 to 98 percent by weight of Ni and 2 to 90 percent by weight of Co in the ratio of Ni and Co forming a composition of an Ni—Co phase, or contains 10 to 98 percent by weight of Ni, 2 to 90 percent by weight of Co and not more than 70 percent by weight of Fe in the ratios of Ni, Co and Fe forming a composition of an Ni—Co—Fe phase. The method involves a second step of liquid-phase sintering the mixed powder in a reducing atmosphere at a temperature that is higher by 10° to 80° C. than the melting temperature of the Ni—Co phase or the Ni—Co—Fe phase. The method preferably avoids a pure solid-phase sintering step by carrying out the sintering step in the stated limited temperature range.

The liquid-phase sintering is carried out at a temperature exceeding the melting temperature of the binder phase, since corrosion resistance and ductility of the alloy as obtained are extremely reduced if the sintering temperature is less than 10° C. higher than the melting temperature of the Ni—Co or Ni—Co—Fe binder phase, due to holes remaining therein as the result of insufficient sintering. If the sintering temperature exceeds 80° C. higher than the melting temperature of the binder phase, on the other hand, deformation is caused during sintering and it is impossible to obtain an alloy having a desired shape. Therefore, the sintering temperature must be in the range from 10° to 80° C. higher than the melting temperature of the Ni—Co or Ni—Co—Fe binder phase.

The tungsten powder serving as raw material powder preferably has a mean particle diameter of about 0.5 to 10

μm, while Ni powder, Co powder and Fe powder for forming the binder phase preferably have particle diameters which are similar to that of the W powder, in order to attain homogeneity in mixing.

The tungsten powder, the Ni powder, the Co powder and the Fe powder contain unavoidable impurities, which are introduced into the alloy as such. It is preferable to minimize the contents of the impurities, especially so that the oxygen content and the carbon content in the mixed powder and in the resultant alloy are not more than 0.1 percent by weight and not more than 0.05 percent by weight respectively, in particular. If the oxygen or carbon content exceeds the above range, sintering is so inhibited that the tungsten based sintered alloy as obtained cannot attain sufficient toughness or sufficient ductility.

Mixed powder including the W powder and the Ni powder or including the W powder, the Ni powder and the Fe powder, which are controlled in composition in the aforementioned manner, are generally shaped into a green compact under a pressure of 1 to 4 ton/cm$^2$, and thereafter liquid-phase sintered in a reducing atmosphere at a temperature which is higher by 10° to 80° C. than the melting temperature of the Ni—Co or Ni—Co—Fe binder phase, as described above. Thereby a tungsten based sintered alloy having excellent corrosion resistance can be obtained. Particularly when the green compact is liquid-phase sintered in a hydrogen atmosphere, the oxygen and the carbon contained in the mixed powder serving as the raw material are reduced or removed, whereby it is possible to effectively reduce the impurities contained in the tungsten based sintered alloy.

The tungsten based sintered alloy obtained in the aforementioned manner is so excellent in corrosion resistance that it will not become corroded under high temperature and high humidity conditions, and can be used for any component in an as-is condition without preservation such as by Ni plating. Further, the inventive tungsten based sintered alloy also has very good toughness and good ductility.

The foregoing and other objects, features, aspects and advantages of the present invention will become more apparent from the following detailed description of the invention when taken in conjunction with the accompanying drawing.

BRIEF DESCRIPTION OF THE DRAWING

The single drawing FIGURE is a composition diagram of binder phase formed by Ni, Co and Fe, showing a composition range of the binder phase for achieving particularly good corrosion resistance in the corrosion-resistant tungsten based sintered alloy according to the first aspect of the present invention.

DETAILED DESCRIPTION OF THE PREFERRED EMBODIMENTS AND OF THE BEST MODE OF THE INVENTION

Figure 1:
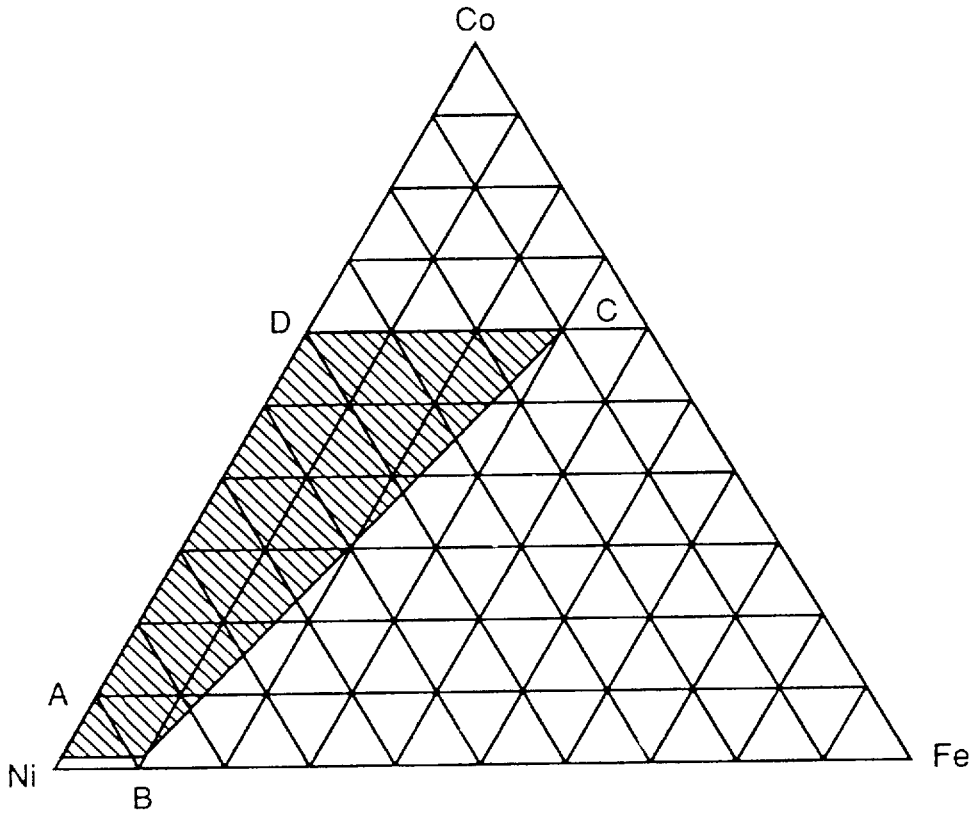

W powder of 2.5 μm in mean particle diameter, Ni powder of 2 μm in mean particle diameter, Co powder of 2 μm in mean particle diameter, and as applicable Fe powder of 4 μm in mean particle diameter were mixed with each other in an attriter with a solvent of methyl alcohol, to be in compositions shown in Table 1. After vacuum elimination of the methyl alcohol, the mixed powder of each sample contained not more than 0.05 percent by weight of oxygen and not more than 0.03 percent by weight of carbon as impurities.

The mixed powder of each sample was mixed with 0.2 percent by weight of camphor, and thereafter shaped into a green compact using a mold under a pressure of 2 ton/cm$^2$. Then, each green compact was heated in a hydrogen atmosphere at 500° C. for 2 hours to eliminate the camphor, and thereafter liquid phase sintered in a hydrogen atmosphere at a temperature of 1500° to 1550° C. for 3 hours, thereby obtaining a tungsten based sintered alloy.

As to the content of unavoidable impurities in the alloy as obtained, the oxygen content was 0.04 percent by weight and the carbon content was 0.02 percent by weight in every sample.

Each tungsten based sintered alloy as obtained was subjected to measurement of specific gravity and a corrosion test of holding the sample under high temperature and high humidity conditions, namely a temperature of 85° C. and humidity of 90% for 96 hours. Table 1 shows the results with the compositions of and sintering temperatures for the respective samples Nos. A1 to A26 according to the first aspect of the present invention.

TABLE 1

| Sample | Composition of W Based Sintered Alloy (wt. %) | Weight Ratio of Ni:Co:Fe | Sintering Temperature (°C.) | Specific Gravity (g/cm$^3$) | Appearance after Corrosion Test |
|---|---|---|---|---|---|
| A1 | 80W—16Ni—2Co—2Fe | 80:10:10 | 1500 | 15.5 | unchanged |
| A2 | 80W—4Ni—14Co—2Fe | 20:70:10 | 1530 | 15.5 | unchanged |
| A3 | 80W—4Ni—4Co—12Fe | 20:20:60 | 1530 | 15.5 | unchanged |
| A4 | 90W—7Ni—1Co—2Fe | 70:10:20 | 1500 | 17.2 | unchanged |
| A5 | 90W—2Ni—6Co—2Fe | 20:60:20 | 1500 | 17.2 | unchanged |
| A6 | 90W—3Ni—1Co—6Fe | 30:10:60 | 1530 | 17.2 | unchanged |
| A7 | 95W—4.9Ni—0.1Co | 98:2:0 | 1530 | 18.2 | unchanged |
| A8 | 95W—3.3Ni—1.5Co—0.2Fe | 70:26:4 | 1500 | 18.2 | unchanged |
| A9 | 95W—0.5Ni—4.5Co | 10:90:0 | 1530 | 18.2 | unchanged |
| A10 | 95W—0.75Ni—4Co—0.25Fe | 15:80:5 | 1530 | 18.2 | unchanged |
| A11 | 95W—0.5Ni—1Co—3.5Fe | 10:20:70 | 1530 | 18.2 | unchanged |
| A12 | 95W—1.4Ni—0.1Co—3.5Fe | 28:2:70 | 1530 | 18.2 | unchanged |
| A13 | 95W—1.25Ni—0.75Co—3Fe | 25:15:60 | 1530 | 18.2 | unchanged |
| A14 | 95W—2.5Ni—1.5Co—1Fe | 50:30:20 | 1500 | 18.2 | unchanged |
| A15 | 95W—3Ni—1.85Co—0.15Fe | 60:32:8 | 1500 | 18.2 | unchanged |
| A16 | 95W—3.5Ni—1.5Co | 70:30:0 | 1530 | 18.2 | unchanged |
| A17 | 97W—0.9Ni—1.5Co—0.6Fe | 30:50:20 | 1500 | 18.6 | unchanged |
| A18 | 97W—0.9Ni—0.9Co—1.2Fe | 30:30:40 | 1530 | 18.6 | unchanged |

TABLE 1-continued

| Sample | Composition of W Based Sintered Alloy (wt. %) | Weight Ratio of Ni:Co:Fe | Sintering Temperature (°C.) | Specific Gravity (g/cm$^3$) | Appearance after Corrosion Test |
|---|---|---|---|---|---|
| A19* | 95W—2.5Ni—2.5Fe | 50:0:50 | 1500 | 18.2 | changed to black |
| A20* | 95W—0.75Ni—0.5Co—3.75Fe | 15:10:75 | 1530 | 18.2 | changed to black |
| A21* | 95W—2.95Ni—0.05Co—2Fe | 59:1:40 | 1500 | 18.2 | changed to black |
| A22* | 95W—0.25Ni—1Co—3.75Fe | 5:20:75 | 1550 | 18.2 | changed to black |
| A23* | 95W—4Co—1Fe | 0:80:20 | 1530 | 18.2 | changed to black |
| A24* | 95W—0.25Ni—4.75Co | 5:95:0 | 1530 | 18.2 | changed to black |
| A25* | 90W—1Ni—1Co—8Fe | 10:10:80 | 1550 | 17.2 | changed to black |
| A26* | 97W—0.15Ni—1.5Co—1.35Fe | 5:50:45 | 1530 | 18.6 | changed to black |

*: comparative samples

From the results shown in Table 1, it is understood that the tungsten based sintered alloys of the samples Nos. A1 to A18 having compositions of Ni—Co and Ni—Co—Fe binder phases which were within the range according to the first aspect of the invention remained unchanged, i.e. uncorroded, and exhibited excellent corrosion resistance in the corrosion test under the high temperature and high humidity conditions. It is also understood that the tungsten based sintered alloys of comparative samples Nos. A19 to A26, including the sample No. A19 of a conventional tungsten based sintered alloy, having compositions of the binder phases which were out of the inventive range, were inferior in corrosion resistance since the samples were easily corroded in the corrosion test, as seen by the formation of black deposits changing the surfaces to black.

Additional samples of tungsten based sintered alloys were prepared in various compositions and subjected to a further investigation of the corrosion resistance, under a more-severe corrosion test of holding the alloy under high temperature and high humidity conditions with a temperature of 85° C. and humidity of 90% for 240 hours. It was found that certain alloys according to the first aspect of the invention have a remarkably excellent corrosion resistance and can withstand the more-severe corrosion test without surface changes. The corrosion resistance was improved particularly when the composition of the Ni—Co binder phase or the Ni—Co—Fe binder phase is in a range which is represented in the composition diagram of the drawing FIGURE, enclosed with a point A (98 percent by weight of Ni and 2 percent by weight of Co), a point B (88 percent by weight of Ni, 2 percent by weight of Co and 10 percent by weight of Fe), a point C (10 percent by weight of Ni, 60 percent by weight of Co and 30 percent by weight of Fe) and a point D (40 percent by weight of Ni and 60 percent by weight of Co).

When surfaces of samples of the inventive tungsten based sintered alloy which were obtained in a similar manner to the above were cut to a depth of 1 mm and the worked surfaces were subjected to a corrosion test similarly to the above, the respective samples exhibited results similar to the above. Thus, it has been understood possible to attain sufficient corrosion resistance also in the interior of the alloy.

Samples of mixed powder having the same composition as the sample No. A15, i.e., 95 percent by weight of W, 3 percent by weight of Ni, 0.5 percent by weight of Co and 1.5 percent by weight of Fe with Ni, Co and Fe in weight ratios of 60:10:30, were shaped and de-camphorated similarly to the above, and green compacts as obtained were sintered in a hydrogen atmosphere at 1400° C. and 1550° C. respectively for 3 hours. The melting temperature of the Ni—Co—Fe binder phase having the above composition is 1450° C.

As the result, the sample which was sintered at 1400° C. was so insufficiently sintered that holes remained therein and its surface was changed to black by black deposits in a similar corrosion test to the above. In the sample which was sintered at 1550° C., on the other hand, deformation was caused during sintering due to the excessive sintering temperature, and it was impossible to maintain the green compact in a correct shape.

Further, a sample of mixed powder having the same composition as the sample No. A8, i.e., 95 percent by weight of W, 3.5 percent by weight of Ni, 1 percent by weight of Co and 0.5 percent by weight of Fe with Ni, Co and Fe in weight ratios of 70:20:10, was shaped and decamphorated similarly to the above, and the green compact as obtained was thereafter liquid-phase sintered in a hydrogen-nitrogen mixed atmosphere at a temperature of 1500° C. for 3 hours. The mixed powder contained 0.17 percent by weight of oxygen and 0.10 percent by weight of carbon, while the tungsten based sintered alloy as obtained contained 0.15 percent by weight of oxygen and 0.07 percent by weight of carbon respectively. On the other hand, the same mixed powder as the above was treated in a similar manner except that liquid-phase sintering was carried out in a hydrogen atmosphere this time. The tungsten based sintered alloy as obtained contained 0.02 percent by weight of oxygen and 0.01 percent by weight of carbon.

When the structure of the former tungsten based sintered alloy (i.e. the alloy sintered in hydrogen-nitrogen mixed gas atmosphere) was observed, blowholes were recognized in the interior of the alloy and it was proved that sintering was inhibited by the oxygen and the carbon contained therein. Further, the sintered alloy was extremely fragile with a low elongation of 2%. When the latter tungsten based sintered alloy (i.e. the alloy sintered in a hydrogen atmosphere) was observed in a similar manner, no blowholes were recognized in the internal structure of the alloy, which was excellent in toughness with a high elongation of 15%.

The alloy compositions of the above described samples A1 to A26 were further tested, and additional alloy samples were prepared by mixing powder materials and then sintering the mixed powder in the manner as described above, in order to provide example embodiments of alloys according to the second aspect of the invention. More specifically, each alloy as obtained was subjected to measurement of its specific gravity, an extremely severe corrosion test of holding the samples under high temperature and high humidity conditions with a temperature of 85° C. and humidity of 90% for a very long period of 480 hours, and measurement of elongation of the alloy. Table 2 shows the results with the compositions of and sintering temperatures for the respective samples Nos. B1 to B56 according to the second aspect of the present invention. Note that the compositions of samples Nos. B21 to B46 correspond to the above samples Nos. A1 to A26, respectively.

TABLE 2

| Sample | Composition of W Based Sintered Alloy (wt. %) | Weight Ratio of Ni:Co:Fe | Sintering Temperature (°C.) | Specific Gravity (g/cm$^3$) | Appearance After Corrosion Test | Elongation (%) |
|---|---|---|---|---|---|---|
| B1 | 80W—8.4Ni—11Co—0.6Fe | 42:55:3 | 1530 | 15.5 | unchanged | 15 |
| B2 | 80W—11Ni—8.4Co—0.6Fe | 55:42:3 | 1530 | 15.5 | unchanged | 17 |
| B3 | 80W—18Ni—1.4Co—0.6Fe | 90:7:3 | 1530 | 15.5 | unchanged | 20 |
| B4 | 90W—6Ni—3.8Co—0.2Fe | 60:38:2 | 1530 | 17.2 | unchanged | 14 |
| B5 | 90W—8Ni—1.8Co—0.2Fe | 80:18:2 | 1530 | 17.2 | unchanged | 16 |
| B6 | 90W—9.3Ni—0.5Co—0.2Fe | 93:5:2 | 1530 | 17.2 | unchanged | 16 |
| B7 | 95W—1.76Ni—3Co—0.24Fe | 35.2:60:4.8 | 1530 | 18.2 | unchanged | 12 |
| B8 | 95W—1.995Ni—3Co—0.005Fe | 39.9:60:0.1 | 1530 | 18.2 | unchanged | 5 |
| B9 | 95W—2.5Ni—2.495Co—0.005Fe | 50:49.9:01 | 1530 | 18.2 | unchanged | 6 |
| B10 | 95W—3.5Ni—1.495Co—0.005Fe | 70:29.9:0.1 | 1530 | 18.2 | unchanged | 6 |
| B11 | 95W—4.895Ni—0.1Co—0.005Fe | 97.9:2:0.1 | 1530 | 18.2 | unchanged | 4 |
| B12 | 95W—4.61Ni—0.1Co—0.24Fe | 93.1:2:4.5 | 1530 | 18.2 | unchanged | 14 |
| B13 | 95W—3.5Ni—1.21Co—0.24Fe | 70.7:24.4:4.8 | 1530 | 18.2 | unchanged | 14 |
| B14 | 95W—2.75Ni—2.01Co—0.24Fe | 55:40.2:4.8 | 1530 | 18.2 | unchanged | 14 |
| B15 | 95W—4.25Ni—0.51Co—0.24Fe | 85:10.2:4.8 | 1530 | 18.2 | unchanged | 19 |
| B16 | 95W—3.75Ni—1.1Co—0.15Fe | 75:22:3 | 1530 | 18.2 | unchanged | 14 |
| B17 | 95W—2.1Ni—2.75Co—0.15Fe | 42:55:3 | 1530 | 18.2 | unchanged | 10 |
| B18 | 95W—4.6Ni—0.25Co—0.15Fe | 92:5:3 | 1530 | 18.2 | unchanged | 10 |
| B19 | 97W—2.4Ni—0.51Co—0.09Fe | 80:17:3 | 1530 | 18.6 | unchanged | 9 |
| B20 | 97W—1.95Ni—0.99Co—0.06Fe | 65:33:2 | 1530 | 18.6 | unchanged | 8 |
| B21* | 80W—16Ni—2Co—2Fe | 80:10:10 | 1500 | 15.5 | slightly changed to brown | 35 |
| B22* | 80W—4Ni—14Co—2Fe | 20:70:10 | 1530 | 15.5 | slightly changed to black | 20 |
| B23* | 80W—4Ni—4Co—12Fe | 20:20:60 | 1550 | 15.5 | slightly changed to black | 25 |
| B24* | 90W—7Ni—1Co—2Fe | 70:10:20 | 1500 | 17.2 | slightly changed to black | 27 |
| B25* | 90W—2Ni—6Co—2Fe | 20:60:20 | 1500 | 17.2 | slightly changed to black | 18 |
| B26* | 90W—3Ni—1Co—6Fe | 30:10:60 | 1530 | 17.2 | slightly changed to black | 23 |
| B27* | 95W—4.9Ni—0.1Co—0Fe | 98:2:0 | 1530 | 18.2 | unchanged | 0.1 |
| B28* | 95W—3.5Ni—1Co—0.5Fe | 70:20:10 | 1500 | 18.2 | slightly changed to brown | 15 |
| B29* | 95W—0.5Ni—4.5Co—0Fe | 10:90:0 | 1530 | 18.2 | stightly changed to black | 0.1 |
| B30* | 95W—0.75Ni—4Co—0.25Fe | 15:80:5 | 1530 | 18.2 | slightly changed to black | 8 |
| B31* | 95W—0.5Ni—1Co—3.5Fe | 10:20:70 | 1550 | 18.2 | slightly changed to black | 10 |
| B32* | 95W—1.4Ni—0.1Co—3.5Fe | 28:2:70 | 1550 | 18.2 | slightly changed to black | 13 |
| B33* | 95W—1.25Ni—0.75Co—3Fe | 25:15:60 | 1530 | 18.2 | slightly changed to black | 15 |
| B34* | 95W—2.5Ni—1.5Co—1Fe | 50:30:20 | 1500 | 18.2 | slightly changed to brown | 21 |
| B35* | 95W—3Ni—0.5Co—1.5Fe | 60:10:30 | 1500 | 18.2 | slightly changed to black | 22 |
| B36* | 95W—3.5Ni—1.5Co—0Fe | 70:30:0 | 1530 | 18.2 | unchanged | 0.1 |
| B37* | 97W—0.9Ni—1.5Co—0.6Fe | 30:50:20 | 1500 | 18.6 | slightly changed to brown | 14 |
| B38* | 97W—0.9Ni—0.9Co—1.2Fe | 30:30:40 | 1530 | 18.6 | slightly changed to black | 13 |
| B39* | 95W—2.5Ni—0Co—2.5Fe | 50:0:50 | 1500 | 18.2 | changed to black | 5 |
| B40* | 95W—0.75Ni—0.5Co—3.75Fe | 15:10:75 | 1550 | 18.2 | changed to black | 11 |
| B41* | 95W—2.95Ni—0.05Co—2Fe | 59:1:40 | 1500 | 18.2 | changed to black | 25 |
| B42* | 95W—0.25Ni—1Co—3.75Fe | 5:20:75 | 1550 | 18.2 | changed to black | 8 |
| B43* | 95W—0Ni—4Co—1Fe | 0:80:20 | 1530 | 18.2 | changed to black | 3 |
| B44* | 95W—0.25Ni—4.75Co—0Fe | 5:95:0 | 1530 | 18.2 | changed to black | 0.1 |
| B45* | 90W—1Ni—1Co—8Fe | 10:10:80 | 1550 | 17.2 | changed to black | 19 |
| B46* | 97W—0.15Ni—1.5Co—1.35Fe | 5:50:45 | 1530 | 18.6 | changed to black | 3 |
| B47* | 80W—17Ni—3Co—0Fe | 85:15:0 | 1530 | 15.5 | unchanged | 0.2 |
| B48* | 80W—11Ni—9Co—0Fe | 55:45:0 | 1530 | 15.5 | unchanged | 0.2 |
| B49* | 80W—10Ni—9Co—1Fe | 50:45:5 | 1530 | 15.5 | slightly changed | 23 |

TABLE 2-continued

| Sample | Composition of W Based Sintered Alloy (wt. %) | Weight Ratio of Ni:Co:Fe | Sintering Temperature (°C.) | Specific Gravity (g/cm$^3$) | Appearance After Corrosion Test | Elongation (%) |
|---|---|---|---|---|---|---|
| | | | | | to brown | |
| B50* | 95W—2.5Ni—2.5Co—0Fe | 50:50:0 | 1530 | 18.2 | unchanged | 0.1 |
| B51* | 95W—2Ni—3Co—0Fe | 40:60:0 | 1530 | 18.2 | unchanged | 0.1 |
| B52* | 95W—4.25Ni—0.5Co—0.25Fe | 85:10:5 | 1500 | 18.2 | slightly changed to brown | 17 |
| B53* | 95W—3Ni—1.75Co—0.25Fe | 60:35:5 | 1530 | 18.2 | slightly changed to brown | 15 |
| B54* | 95W—4.65Ni—0.1Co—0.25Fe | 93:2:5 | 1530 | 18.2 | slightly changed to brown | 15 |
| B55* | 95W—1.75Ni—3Co—0.25Fe | 35:60:5 | 1530 | 18.2 | slightly changed to brown | 13 |
| B56* | 97W—2.1Ni—0.75Co—0.15Fe | 70:25:5 | 1530 | 15.5 | slightly changed to brown | 13 |

*: comparative samples

From the results shown in Table 2, it is understood that the tungsten based sintered alloys of the samples Nos. B1 to B20 having compositions of Ni—Co—Fe binder phases which were within the inventive range of the second aspect of the invention had a high toughness in addition to a particularly good corrosion resistance. It is desired that the alloys should have a toughness represented by an elongation of at least 1%, and samples Nos. B1 to B20 have elongations of at least 4% (sample No. B11) and ranging up to 20% (sample No. B3). Furthermore, the samples remained unchanged by corrosion, i.e. exhibited excellent corrosion resistance, even in the severe corrosion test under high temperature and high humidity conditions for a long period of time, i.e. 480 hours. On the other hand, the tungsten based sintered alloys of comparative samples Nos. B21 to B56, having compositions of the binder phases which were out of the range of the second aspect of the invention suffered the following defects. Samples Nos. B21 to B26, B28 to B35, B37 to B46, B49, and B52 to B56 were corroded by the corrosion test with formation of black or brown deposits changing the surfaces to black or brown. Further, it is understood that the samples Nos. B27, B36, B47, B48, B50 and B51 had no toughness, with an elongation well below 1%, i.e. of not more than 0.2%, which allows no plastic deformation, although the surfaces thereof were not changed in color by corrosion.

Further, the surface of each tungsten based sintered alloy according to the second aspect of the present invention which was obtained similarly to the aforementioned samples was cut to a depth of 1 mm, and a corrosion test similar to the above was made on the worked surface. Each sample attained a result similar to the above results for the surface corrosion. Thus, it has been understood that sufficient corrosion resistance was attained also in the interior of the alloy.

Then, a sample of mixed powder having the same composition as the sample No. B16, i.e., 95 percent by weight of W, 3.75 percent by weight of Ni, 1.1 percent by weight of Co and 0.15 percent by weight of Fe with Ni, Co and Fe in weight ratios of 75:22:3, was shaped and de-camphorated similarly as described above, and the green compact as obtained was thereafter sintered in a hydrogen-nitrogen mixed atmosphere at a temperature of 1530° C. for 3 hours. The mixed powder contained 0.17 percent by weight of oxygen and 0.10 percent by weight of carbon, while the tungsten based sintered alloy as obtained contained 0.15 percent by weight of oxygen and 0.07 percent by weight of carbon respectively. On the other hand, the same mixed powder as the above was treated in a similar manner except that liquid-phase sintering was carried out in a hydrogen atmosphere this time. The tungsten based sintered alloy as obtained contained 0.02 percent by weight of oxygen and 0.01 percent by weight of carbon.

When the structure of the former tungsten based sintered alloy (i.e. the alloy sintered in a hydrogen-nitrogen mixed gas atmosphere) was observed, blowholes were recognized in the interior of the alloy and it was proved that sintering was inhibited by the oxygen and the carbon contained therein. Further, the sintered alloy was extremely fragile with a low elongation of 1%. When the latter tungsten based sintered alloy (i.e. the alloy sintered in a hydrogen atmosphere) was observed in a similar manner, no blowholes were recognized in the interior of the alloy, which was excellent in toughness with a high elongation of 14%.

According to the present invention, it is possible to provide a tungsten based sintered alloy having both excellent corrosion resistance and toughness while maintaining a prescribed high specific gravity. Thus, the inventive tungsten based sintered body can be employed as such without requiring corrosion protection or preservation such as Ni plating, in high productivity for application to an inertial body or the like. Thus, it is possible to provide a tungsten based sintered alloy having high reliability and the capability for working the alloy, for example by caulking, at a low cost.

As can be seen from the samples in above Tables 1 and 2, the present invention provides tungsten based sintered alloy compositions having an excellent corrosion resistance and other physical properties, with compositions outside of the composition ranges disclosed by the prior art. For example, regarding W—Ni—Co alloys, Mullendore et al. '462 disclose an alloy composition of 90 to 98 wt. % tungsten, with the balance being nickel and cobalt, wherein the weight ratio of nickel to cobalt is between 50:50 and 90:10. In contrast, present samples A7 (B27), A9 (B29), B50 and B51 show that W—Ni—Co alloy compositions having weight ratios of Ni:Co in a first range from and including 50:50 to and including 10:90, and in a second range from and including 98:2 to and including 90:10 exhibit very good corrosion resistance. More specifically, all of these just-listed samples withstood the 96 hour corrosion test, and among these samples only sample A9 (B29) was slightly corroded in the severe 480 hour corrosion test, while the remaining samples were not corroded even in the severe test.

Regarding W—Ni—Co—Fe sintered alloys, the above described samples show that alloy compositions outside of the prior art ranges provide good corrosion resistance and also good toughness. For example, Penrice et al. '559 disclose tungsten based alloy compositions in which the weight ratios of alloying elements in the binder phase are about 30 to 90% nickel, 5 to 65% iron, and 5 to 47.5% cobalt, with the amount of cobalt being at least equal to or less than the nickel content. In contrast thereto, the present samples B1, B7, B8, B17, B22, B23, B25, B30, B31, B32, B33, B37, and B55, for example, show that good corrosion resistance and good toughness are achieved by alloy compositions having a cobalt content greater than the nickel content or having a nickel content of less than 30 wt. %, according to the first aspect of the present invention. Furthermore, present samples B1, B7, B8, B9, B17, B22, B25, B30, B37, and B55, for example, show that the cobalt content can be greater than 47.5% in a W—Ni—Co—Fe alloy to achieve good corrosion resistance and toughness, directly contrary to the teachings of Penrice et al. '559.

The second aspect of the present invention provides W—Ni—Co—Fe alloys having particularly good corrosion resistance and particularly good toughness. These alloys have a Co content of at least 2 wt. % and not more than 90 wt. % (preferably not more than 60 wt. %), an Fe content of more than 0 wt. % and less than 5 wt. %, and a remainder of Ni in the Ni—Co—Fe binder phase. The second aspect of the present invention is represented by numerous of the above described samples having a lower Fe content than disclosed by Penrice et al. '559 and a greater Fe content than disclosed by Mullendore et al. '462.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A corrosion-resistant sintered alloy consisting of 80 to 97 percent by weight of W and a remainder of Ni, Co and unavoidable impurities, wherein said Ni and said Co form a Ni—Co binder phase with at least 10 and less than 50 percent by weight of said Ni, and with more than 50 and not more than 90 percent by weight of said Co.

2. The corrosion-resistant sintered alloy in accordance with claim 1, wherein said binder phase has at least 40 and less than 50 percent by weight of said Ni and has more than 50 and not more than 60 percent by weight of said Co.

3. The corrosion-resistant sintered alloy in accordance with claim 1, wherein said unavoidable impurities include not more than 0.10 percent by weight of oxygen and not more than 0.05 percent by weight of carbon.

4. The corrosion-resistant sintered alloy in accordance with claim 1, containing at least 80 and less than 90 percent by weight of said W.

5. The corrosion-resistant sintered alloy in accordance with claim 1, having a specific gravity of about 18.2 g/cm$^3$.

6. A corrosion-resistant sintered alloy consisting of 80 to 97 percent by weight of W and a remainder of Ni, Co and unavoidable impurities, wherein said Ni and said Co form a Ni—Co binder phase with more than 90 and not more than 98 percent by weight of said Ni, and with at least 2 and less than 10 percent by weight of said Co.

7. The corrosion-resistant sintered alloy in accordance with claim 6, wherein said unavoidable impurities include not more than 0.10 percent by weight of oxygen and not more than 0.05 percent by weight of carbon.

8. The corrosion-resistant sintered alloy in accordance with claim 6, containing at least 80 and less than 90 percent by weight of said W.

9. The corrosion-resistant sintered alloy in accordance with claim 6, having a specific gravity of about 18.2 g/cm$^3$.

10. A corrosion-resistant sintered alloy consisting of 80 to 97 percent by weight of W and a remainder of Ni, Co, Fe and unavoidable impurities, wherein said Ni, said Co and said Fe form a Ni—Co—Fe binder phase having a composition in which the respective contents of Ni, Co and Fe, relative to the total content of Ni, Co and Fe, include an Fe content of more than 0 and not more than 70 percent by weight, a Co content of at least 2 and not more than 90 percent by weight, and an Ni content of at least 10 percent by weight and less than X percent by weight where X is the greater of 30 percent by weight and said Co content.

11. The corrosion-resistant sintered alloy in accordance with claim 10, wherein said Co content is greater than said Ni content and not more than 60 percent by weight, and said Fe content is not more than a content defined along a compositional line extending from a composition point B (88 percent by weight of Ni, 2 percent by weight of Co and 10 percent by weight of Fe) to a composition point C (10 percent by weight of Ni, 60 percent by weight of Co and 30 percent by weight of Fe) in a ternary composition diagram of said Ni—Co—Fe binder phase composition.

12. The corrosion-resistant sintered alloy in accordance with claim 11, wherein said Co content is greater than 47.5 percent by weight.

13. The corrosion-resistant sintered alloy in accordance with claim 10, wherein said Co content is greater than 47.5 percent by weight.

14. The corrosion-resistant sintered alloy in accordance with claim 10, wherein said unavoidable impurities include not more than 0.10 percent by weight of oxygen and not more than 0.05 percent by weight of carbon.

15. The corrosion-resistant sintered alloy in accordance with claim 10, containing at least 80 and less than 85 percent by weight of said W.

16. The corrosion-resistant sintered alloy in accordance with claim 10, having a specific gravity between about 15.5 g/cm$^3$ and 18.6 g/cm$^3$.

17. The corrosion-resistant sintered alloy in accordance with claim 10, wherein said Ni content is at least 10 percent by weight and less than 30 percent by weight.

18. The corrosion-resistant sintered alloy in accordance with claim 17, wherein said Ni content is at least 10 percent by weight and less than 30 percent by weight and less than said Co content.

19. The corrosion-resistant sintered alloy in accordance with claim 10, wherein said Ni content is at least 10 percent by weight and less than said Co content.

* * * * *

UNITED STATES PATENT AND TRADEMARK OFFICE

CERTIFICATE OF CORRECTION

PATENT NO. : 5,821,441

DATED : Oct. 13, 1998

INVENTOR(S) : Kawamura

It is certified that error appears in the above-identified patent and that said Letters Patent is hereby corrected as shown below:

Col. 6, Table 1, Col. 2, line 8,
below the heading: replace "95W-3.3Ni-1.5Co-0.2Fe" by --95W-3.3Ni-1.3Co-0.2Fe--;

Table 1, Col. 3, line 15,
below the heading: replace "60:32:8" by --60:37:3--.

Col. 9, Table 2, Col. 3, line 12,
below the heading: replace "93:1:2:4.5" by --93.1:2:4.8--.

Signed and Sealed this

Second Day of March, 1999

*Attest:*

Q. TODD DICKINSON

*Attesting Officer*

*Acting Commissioner of Patents and Trademarks*